US006004059A

United States Patent [19]

Zaccaria

[11] Patent Number: 6,004,059

[45] Date of Patent: Dec. 21, 1999

[54] DISPOSABLE TOOTHBRUSH HAVING AN EDIBLE TOOTHPASTE COMPOSITION

[76] Inventor: James M Zaccaria, 9 Shoredale Dr., Manhasset, N.Y. 11030

[21] Appl. No.: 09/087,366

[22] Filed: May 29, 1998

[51] Int. Cl.[6] ..... A46B 11/00

[52] U.S. Cl. ..... 401/268; 401/7

[58] Field of Search ..... 401/268, 7, 284, 401/292, 282

[56] References Cited

U.S. PATENT DOCUMENTS

| | | | |
|---|---|---|---|
| 2,649,959 | 8/1953 | Hallahan . | |
| 2,778,045 | 1/1957 | Bly et al. | 15/131 |
| 3,952,867 | 4/1976 | McCord . | |
| 4,530,129 | 7/1985 | Labick et al. | 401/268 |
| 5,068,941 | 12/1991 | Dunn . | |
| 5,107,562 | 4/1992 | Dunn . | |
| 5,213,428 | 5/1993 | Salman | 401/7 |
| 5,287,584 | 2/1994 | Skinner . | |
| 5,304,009 | 4/1994 | Marshall | 401/268 |
| 5,348,153 | 9/1994 | Cole | 401/7 |
| 5,400,457 | 3/1995 | Ridgley | 401/268 |
| 5,476,334 | 12/1995 | Tello-Vallarino | 401/268 |
| 5,524,764 | 6/1996 | Kaufman et al. . | |
| 5,605,756 | 2/1997 | Sanduja et al. . | |

*Primary Examiner*—David J. Walczak
*Attorney, Agent, or Firm*—Weiss & Weiss

[57] ABSTRACT

A disposable toothbrush having an edible toothpaste preapplied. The toothbrush can be made so as to be adjustable in length.

11 Claims, 3 Drawing Sheets

DISPOSABLE TOOTHBRUSH HAVING AN EDIBLE TOOTHPASTE COMPOSITION

BACKGROUND OF THE INVENTION

1. Field of the Invention

The present invention relates to a disposable toothbrush having an edible toothpaste composition.

2. Description of the Prior Art

Toothbrushes have been designed that can be used for a single use. These disposable toothbrushes have eliminated the need for a separate tube of toothpaste by incorporating in or on the toothbrush a sufficient amount of toothpaste.

U.S. Pat. No. 5,605,756 discloses a disposable toothbrush having a flavored toothpaste composition bonded to the bristles of the toothbrush. The process involves the chemical grafting and polymerizing of selected monomers and prepolymers to the bristles via a free radical mechanism. When the toothpaste is brought into contact with an aqueous medium, such as saliva in the oral cavity, the toothpaste dissolves thereby releasing the desired flavor to the teeth and oral cavity.

U.S. Pat. No. 5,524,764 discloses a combination absorbent applicator, wipe for teeth and oral applicator comprising a sheath having a closed distal end and an open proximal end for receipt of a finger. An abrasive absorbent pad is on an exterior surface and can be applied to teeth, gums, tongue and lips for cleaning and treatment.

U.S. Pat. Nos. 5,068,941, 5,107,562, 5,213,428 and 5,287,584 are all directed to a finger toothbrush. The '562 patent and the '428 patent describe disposable finger mounted toothbrushes.

U.S. Pat. No. 5,304,009 discloses a disposable toothbrush having a supply of dehydrated toothpaste adhered to a bristle portion .

U.S. Pat. No. 2,649,959 discloses a toothbrush package in which the bristles of a portable toothbrush are coated with a mass of dried toothpaste.

None of the above prior art inventions solve the problem of using a toothbrush without having to rinse out the toothpaste.

U.S. Pat. No. 3,952,867 discloses a disposable cleaning apparatus including a sealed package having a first and second separate compartments. The first compartment includes ingestible toothpaste for cleaning the teeth which can be swallowed without causing any unpleasantness and therefore does not require mouth rinsing or available water facilities. The second compartment includes an applicator having an opening and is sized and shaped for insertion over a finger whereby the teeth may be brushed by the finger after applying the toothpase to the applicator. This device does not use a tooth brush, but uses the finger to brush the teeth.

For the foregoing reasons, there is a need for an individually wrapped, inexpensive disposable toothbrush having an edible toothpaste composition distributed over the bristles of the toothbrush.

3. SUMMARY OF THE INVENTION

It is therefore an object of the present invention to provide a disposable toothbrush having an edible toothpaste applied to the bristles of the toothbrush.

It is a further object of the invention to provide an edible toothpaste, which can be swallowed by the user, so that no rinsing is required to dispose of the toothpaste.

It is a further object of the invention to provide a disposable toothbrush which is coated with an amount of toothpaste sufficient for a single tooth brushing operation such that the toothbrush may be disposed after initial use.

It is a further object of the invention to provide a toothbrush which can fit within the shirt pocket of an individual so that an individual can carry the toothbrush while he is driving.

It is a further object of the invention to provide a toothbrush having an adjustable length; one length for storing and a second length for brushing.

It is still another object of the invention to provide a disposable toothbrush and toothpaste product that can be produced at a low cost.

The toothbrush of the present invention allows one to have the availability of a toothbrush at any time and at any place without the need of toothpaste or water for rinsing. The toothbrush of the present invention is disposable and may be formed of a biodegradable material such as a biodegradable plastic. The toothbrush would fit preferably in the shirt pocket of an individual. The invention is ideally suited for a person driving in his car who does not have use of water for rinsing away the toothpaste.

These and other advantages, features and elements of the preferred embodiments of the present invention will become more apparent from the drawings and description appended hereto.

4. BRIEF DESCRIPTION OF DRAWING FIGURES

5. DESCRIPTION OF PREFERRED EMBODIMENTS

Figure 1:
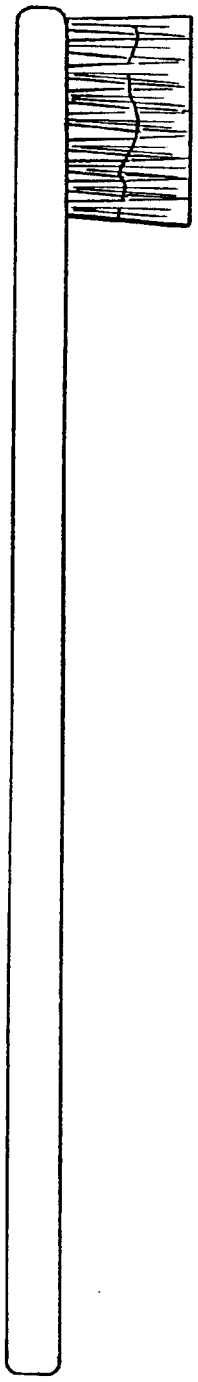
FIG. 1 is a side view of a prior art toothbrush.

FIG. 1 illustrates a prior art toothbrush. The toothbrush is large and is not made to fit within a pocket or compartment of a person's wardrobe.

Figure 2:
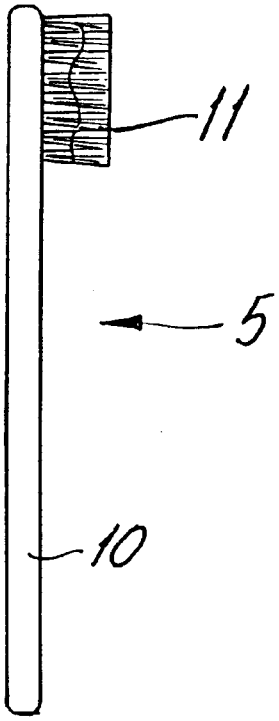
FIG. 2 is a side view of a toothbrush of the present invention.
Figure 3:
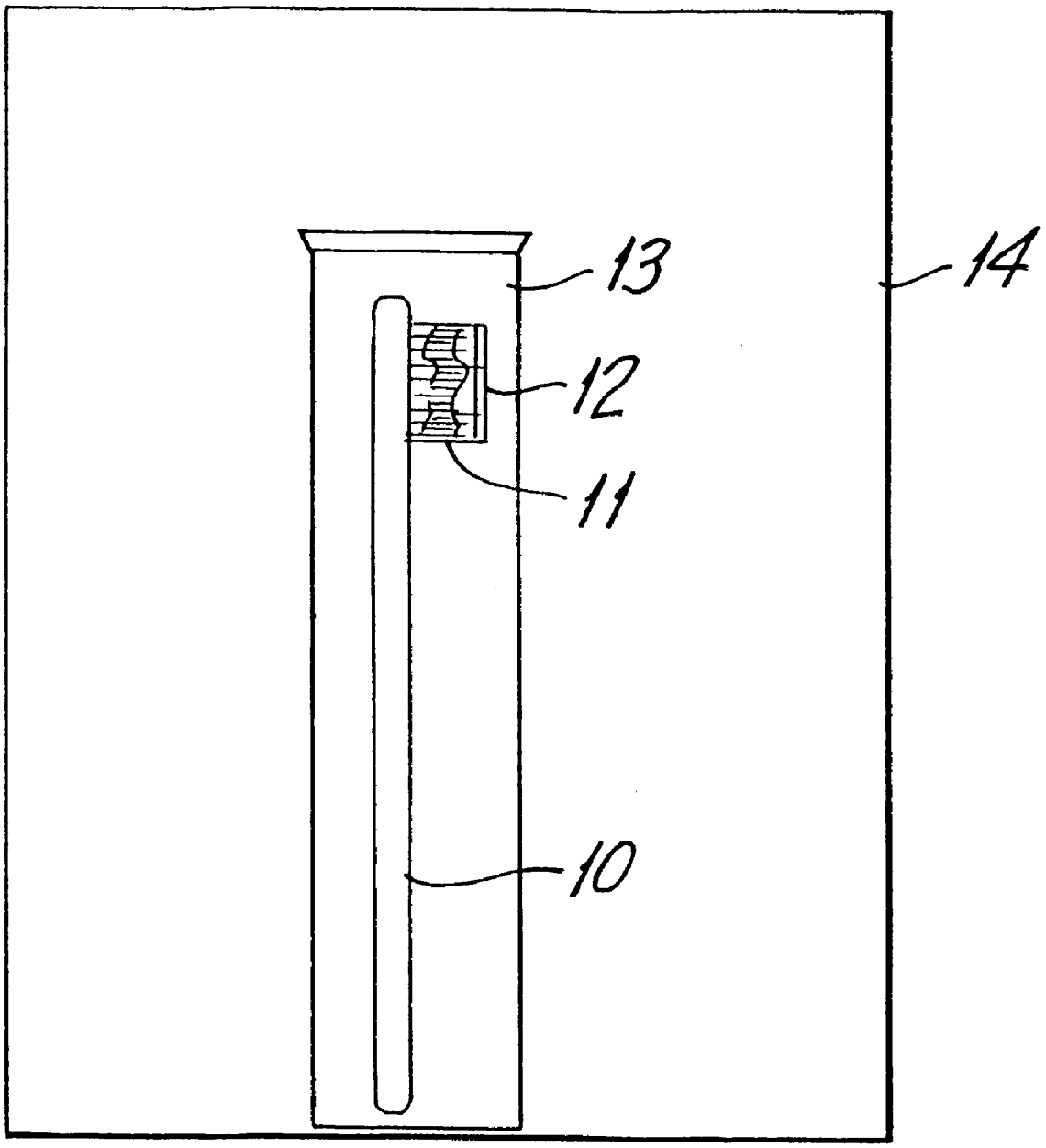
FIG. 3 is a side view of a toothbrush of the present invention, having been applied with the edible toothpaste, contained within a shirt pocket.

FIG. 2 illustrates a preferred embodiment of a toothbrush of the present invention. The toothbrush 5 has a handle 10 and bristles 11. The toothbrush is approximately about two to about four inches in length and as shown in FIG. 3 fits within a pocket 14 of a person's shirt pocket. The toothbrush 5 is made of an inexpensive material, such as plastic, or possibly a biodegradable material. An edible toothpaste 12 is preapplied to the bristles 11. Although a smaller toothbrush 5 is preferred, any toothbrush having the preapplied edible toothpaste is disclosed by this invention. The toothbrush 5 has a preapplied edible toothpaste 12 placed on the bristles 11 and then it is placed in an airtight container 13 until it is to be used. The airtight container 13 can be made of plastic or any other material that will keep the toothpaste 12 as fresh as possible so that it can have a longer shelf life.

Figure 4:
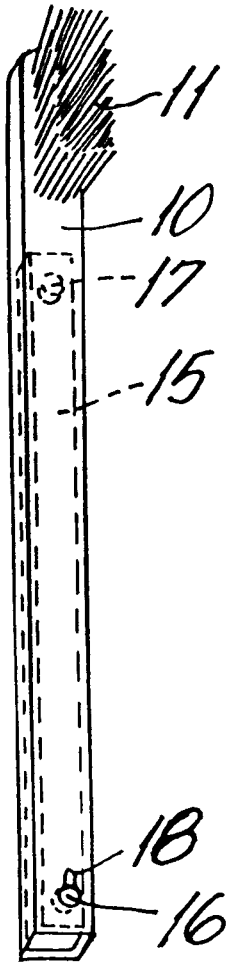
FIG. 4 is a front view of an embodiment of a toothbrush of the present invention.
Figure 5:
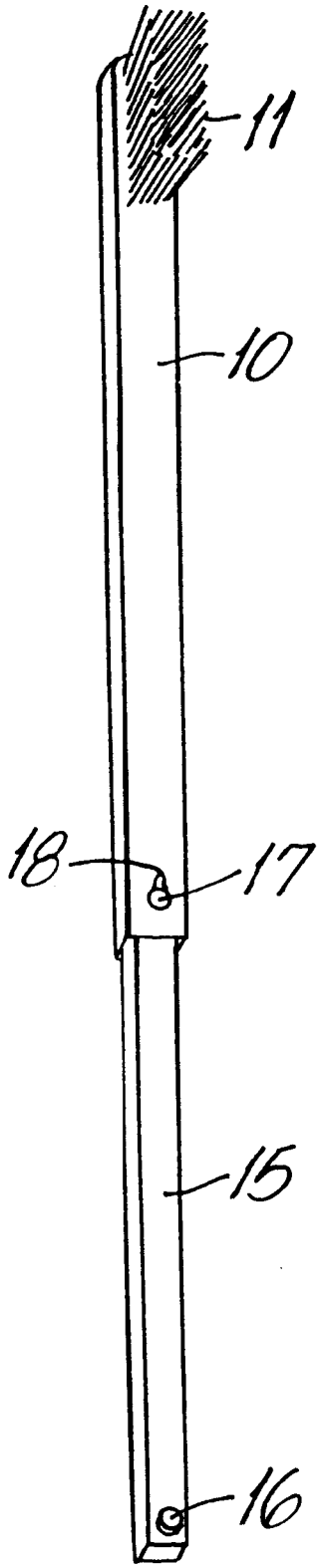
FIG. 5 is a front view of an embodiment of a toothbrush of the present invention.

FIG. 4 illustrates a further embodiment of the invention. FIG. 4 illustrates that the handle 10 is hollow and contains a further handle 15 within. Plug 18 when placed in hole 16 holds the further handle 15 within handle 10. This smaller toothbrush 5 is placed within a pocket or other compartment of a person's wardrobe. When the individual is ready to brush, plug 18 is removed from hole 16, further handle 15 is slid down and the plug 18 is then reinserted into hole 17. The toothbrush 5 has now been extended in length and is easier for an individual to brush.

One suitable formula for ingestible toothpaste is described in U.S. Pat. No. 3,952,867. The formula contains:

Insoluble sodium metaphosphate 1200 grams
Dicatcium phosphate 200 grams
Glycerine 1160 grams
Sodium carboxynathylcellulose 50 grams
Saccharin 4 grams
Water 1390 grams
Oil of spearmint 16 grams Other formulations of edible toothpaste can be used with this invention. Any other flavor additive known can be added to the composition above.

The embodiment of the present invention eliminates the need for a complex and expensive article that is intended to be used only once. It eliminates, when traveling, the need for packing both a toothbrush and a tube of toothpaste.

While preferred embodiments of the present invention have been described, variations thereto will occur to those skilled in the art and are within the scope of the present inventive concepts which are delineated by the following claims.

What is claimed is:

1. A disposable biodegradable toothbrush, comprising:

a handle including an elongated rigid body adapted to be gripped in a user's hand during use; and bristles at one end of said toothbrush;

said bristles having edible toothpaste pre-applied; said edible toothpaste being adapted to be ingested and the edible toothpaste not needing water for use.

2. The invention of claim 1 wherein the toothbrush is adapted to be fitted within a shirt pocket of an individual.

3. The invention of claim 1 wherein said toothbrush is approximately about two to about four inches in length.

4. The invention of claim 1 wherein said toothbrush is at one length when stored, and at an expanded length when used to brush an individual's teeth.

5. The invention of cllaim 1 wherein said toothbrush is stored in an airtight container.

6. A disposable toothbrush unit comprising:

a handle having an elongated rigid body and being adapted to be gripped in a user's hand during use; and bristles at one end of said toothbrush unit; wherein said bristles have edible toothpaste pre-applied thereon;

said edible toothpaste being adapted to be ingested and not requiring water for use; said toothbrush unit having a length of approximately about 2 inches to about 4 inches.

7. The toothbrush unit of claim 6, further comprising an airtight container, wherein said toothbrush unit is stored in said airtight container.

8. The toothbrush unit of claim 6 wherein said toothbrush unit is biodegradable.

9. A disposable biodegradable toothbrush unit, comprising:

a handle having an elongated rigid body and being adapted to be gripped in a user's hand during use; and bristles at one end of said toothbrush unit; wherein said bristles have edible toothpaste pre-applied thereon;

said edible toothpaste being adapted to be ingested and not requiring water for use, said toothbrush unit having a compacted length when in a stored state and having an expanded length when used to brush a user's teeth.

10. The toothbrush unit of claim 9, further comprising an airtight container, wherein said toothbrush unit is stored in said airtight container.

11. The toothbrush unit of claim 9 wherein said compacted length is approximately 2 to 4 inches.

* * * * *